US005104247A

United States Patent [19]

Ohshima

[11] Patent Number: 5,104,247

[45] Date of Patent: Apr. 14, 1992

[54] RECORDING CONTROL METHOD, RECORDING METHOD, AND RECORDING APPARATUS FOR MULTICOLOR INK RIBBON

[75] Inventor: Noriyoshi Ohshima, Tokyo, Japan

[73] Assignee: Canon Kabushiki Kaisha, Tokyo, Japan

[21] Appl. No.: 759,955

[22] Filed: Sep. 17, 1991

Related U.S. Application Data

[63] Continuation of Ser. No. 553,418, Jul. 17, 1990, abandoned.

[30] Foreign Application Priority Data

Jul. 18, 1989 [JP] Japan ..... 1-183614
Jul. 18, 1989 [JP] Japan ..... 1-183615
Jul. 18, 1989 [JP] Japan ..... 1-183616

[51] Int. Cl.[5] ..... B41J 3/09

[52] U.S. Cl. ..... 400/240.3; 400/240.4

[58] Field of Search ..... 400/240, 249, 240.3, 400/240.4, 240.1, 240.2, 207, 208, 194; 346/76

[56] References Cited

U.S. PATENT DOCUMENTS

| | | | |
|---|---|---|---|
| 4,401,390 | 8/1983 | Melissa et al. | 400/240.3 |
| 4,505,603 | 3/1985 | Yana | 400/240.3 |
| 4,551,729 | 11/1985 | Kubo et al. | 400/240.3 |
| 4,616,236 | 10/1986 | Watanabe et al. | 400/240.3 |
| 4,620,199 | 10/1986 | Tatsumi et al. | 400/240.3 |
| 4,625,218 | 11/1986 | Watanabe | 400/240.3 |
| 4,638,330 | 1/1987 | Watanabe | 400/240.3 |
| 4,652,154 | 3/1987 | Horiya et al. | 400/240.3 |
| 4,687,359 | 8/1987 | Barrus et al. | 400/240.3 |
| 4,771,296 | 9/1988 | Shimada | 400/240.3 |
| 4,827,286 | 5/1989 | Sukigara et al. | 346/76 PH |
| 4,893,951 | 1/1990 | Iwatani et al. | 400/240.3 |

FOREIGN PATENT DOCUMENTS

| | | | |
|---|---|---|---|
| 3425951 | 1/1985 | Fed. Rep. of Germany . | |
| 0008187 | 1/1982 | Japan | 400/249 |
| 0039590 | 3/1984 | Japan | 400/249 |
| 59-184689 | 10/1984 | Japan . | |
| 60-23090 | 2/1985 | Japan | 400/240.3 |
| 0064867 | 4/1985 | Japan | 400/240.3 |
| 0031273 | 2/1986 | Japan | 400/240.3 |
| 0031282 | 2/1986 | Japan | 400/240.3 |
| 0160267 | 7/1986 | Japan | 400/240.3 |
| 0215084 | 9/1986 | Japan | 400/240.3 |
| 0217278 | 9/1986 | Japan | 400/240.3 |
| 0235181 | 10/1986 | Japan | 400/240.3 |
| 0239968 | 10/1986 | Japan | 400/240.3 |
| 0128779 | 6/1987 | Japan | 400/240.3 |
| 63-209981 | 8/1988 | Japan . | |
| 0214472 | 9/1988 | Japan | 400/249 |
| 1-135681 | 5/1989 | Japan . | |

*Primary Examiner*—Eugene H. Eickholt
*Attorney, Agent, or Firm*—Fitzpatrick, Cella, Harper & Scinto

[57] ABSTRACT

A multicolor ink ribbon recording control method using a multicolor ink ribbon sequentially having inks of at least two colors includes a discrimination structure, formed in an ink ribbon cassette, for discriminating in accordance with a loading state of the cassette in a printer whether a continuous ink coated portion of each color is divisionally used, and a recognizing unit, provided in a printer, for recognizing a state of the discrimination structure of a loaded ink ribbon cassette, and a recording control unit, provided in a printer, for performing recording control in accordance with a recognition result of the recognizing unit. Whether divisional use is to be performed is determined in accordance with the discrimination structure formed in the ink ribbon cassette. When divisional use is determined, a continuous coated portion of an ink of the same color is virtually divided into a plurality of areas and one of the plurality of areas is used to perform recording, a loading direction is reversed when one reel of an ink ribbon is recorded to the end, and the ink ribbon is reused under recording control according to a new discrimination result of the discrimination structure.

17 Claims, 10 Drawing Sheets

RECORDING CONTROL METHOD, RECORDING METHOD, AND RECORDING APPARATUS FOR MULTICOLOR INK RIBBON

This application is a continuation of application Ser. No. 07/553,418 filed on July 17, 1990 and now abandoned.

BACKGROUND OF THE INVENTION:

1. Field of the Invention

The present invention relates to a recording method of performing recording on a recording medium by using a multicolor ink ribbon, a recording apparatus using the recording method, and a recording control method of the multicolor ink ribbon.

2. Related Background Art

A multicolor ink ribbon for a serial printer is obtained by sequentially coating a plurality of inks of different colors each having a predetermined length in a frame-sequence manner on the surface of a film having a predetermined width. In order to discriminate the coated colors, a bar code is formed on each color coated portion.

Conventionally, in order to perform recording by using this ink ribbon, the ink ribbon is wound before recording to read the bar codes until a desired color portion is detected. When the desired color portion is detected, recording is sequentially performed for each color from the desired color.

In this case, the length of the ink coated portion of each color (the length of a portion on which the same color is continuously coated) is predetermined. For this reason, in order not to record the next color beyond a given color portion, a maximum recording length of continuous recording in each color is set beforehand so that continuous recording is not performed beyond the length.

In order to perform recording exceeding the maximum continuous recording length, therefore, a recording operation is temporarily stopped, and the ink ribbon is wound to monitor the bar codes until the same color coated portion is detected at the next recording position. When the same color portion is detected, recording of the remaining portion is resumed. Unfortunately, an ink portion of another color coated between the recorded color is not used but unnecessarily wound.

In order to eliminate this drawback, a continuous ink coated length of each color may be increased. If the continuous ink coated portion is too long, however, a certain color is recorded only by a small amount and then another color is to be recorded, however, a large portion of the continuous ink coated length of the first color is unnecessarily wound without being used.

In a conventional system, therefore, in consideration of the width of a recording sheet, the continuous ink coated length is determined to be slightly longer than the recording sheet width so that recording can be continuously performed with respect to the longitudinal dimension (=257 mm) of a B4-size recording sheet or the longitudinal dimension (=210 mm) of an A4-size recording sheet.

In the above conventional system, however, a unit continuous recording length is taken into consideration. Therefore, if a narrow sheet such as a post card is used, the recording range is narrow. For this reason, a large amount of one continuous ink coated portion is unnecessarily wound without being used.

In order to solve this problem, in addition to a conventional ink ribbon, a specific ink ribbon having a short continuous ink coated length may be formed for a narrow sheet such as a post card. However, this method is not practical when manufacturing cost, the need for a method of discriminating between the two types of ink ribbons, and possible erroneous operation by a user are taken into consideration.

SUMMARY OF THE INVENTION

It is an object of the present invention to provide a recording control method, a recording method, and a recording apparatus for a multicolor ink ribbon, which can improve a use efficiency of an ink ribbon.

It is another object of the present invention to provide a recording control method, a recording method, and a recording apparatus for a multicolor ink ribbon, which can perform color recording.

It is still another object of the present invention to provide a recording control method, a recording method, and a recording apparatus for a multicolor ink ribbon, which can perform clear recording.

It is still another object of the present invention to provide a recording control method, a recording method, and a recording apparatus for a multicolor ink ribbon, which comprise detecting means for detecting an ink ribbon position of each color, recording means for virtually dividing a continuous ink coated portion detected by the detecting means into a predetermined number of areas and performing recording in units of divided areas, and designating means for designating a desired number of divided areas and a desired number of use.

It is still another object of the present invention to provide a recording control method, a recording method, and a recording apparatus for a multicolor ink ribbon, which can perform recording by dividing a continuous ink coated portion of each color into a plurality of areas, thereby decreasing an amount of an ink nonused portion of an ink ribbon to increase a use efficiency of the ink ribbon.

It is still another object of the present invention to provide a recording control method, a recording method, and a recording apparatus for a multicolor ink ribbon, in which recording control means determines in accordance with a discrimination structure formed in an ink ribbon cassette whether an ink ribbon can be divided, if the ink ribbon can be divided, color recording is performed by using a continuous coated portion of an ink of the same color divided into a predetermined number of areas, and when one reel of ink ribbon is used up, the loading direction of the cassette is reversed to use the ink ribbon under recording control according to a discrimination result obtained by a new discrimination structure.

It is still another object of the present invention to provide a recording control method, a recording method, and a recording apparatus for a multicolor ink ribbon, which can divide one continuous ink coated portion of each color into a plurality of areas and repeatedly use the portion in recording a plurality of times equal to the number of divided areas, thereby decreasing the amount of the ink ribbon left unused to increase a use efficiency of the ink ribbon.

DETAILED DESCRIPTION OF THE PREFERRED EMBODIMENTS

Preferred embodiments of the present invention will be described in detail below with reference to the accompanying drawings.

1st Embodiment

Figure 1:
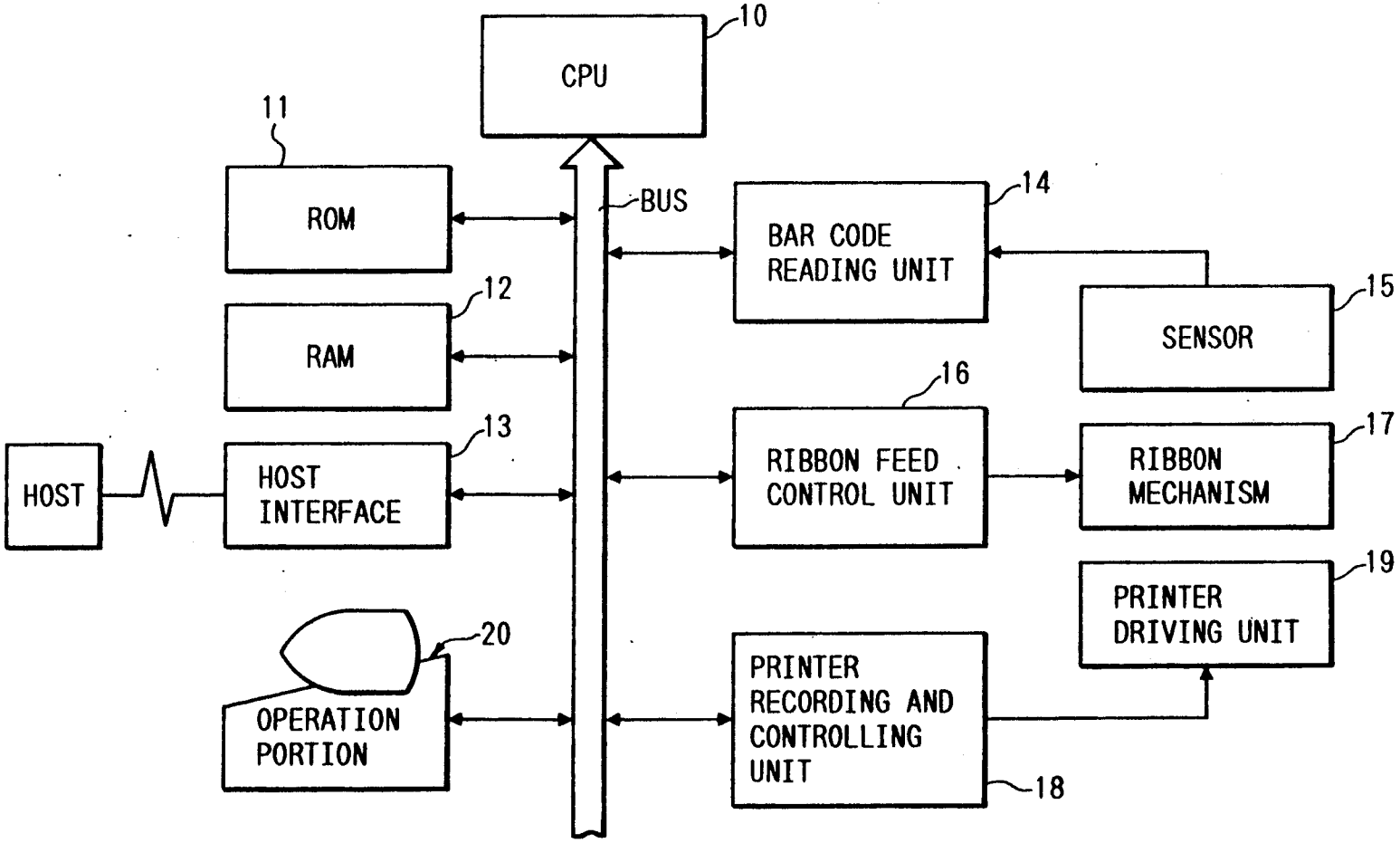
FIG. 1 is a block diagram showing the first embodiment according to the present invention.

FIG. 1 is a block diagram showing a color printer according to the first embodiment of the present invention. Referring to FIG. 1, a CPU 10 controls the overall embodiment in accordance with control sequences shown in FIGS. 8 and 9 (to be described later) stored in a ROM 11, the ROM 11 stores the above control sequences and the like, a RAM 12 stores recording information and the like supplied from a host, a host interface 13 is connected to external equipment such as a host computer, a bar code reading unit 14 reads a bar code indicating an ink color of a color ink ribbon (to be described later), and a sensor 15 reads the bar code. This printer also comprises a ribbon feed control unit 16, a ribbon mechanism 17, a printer recording and controlling unit 18, a printer driving unit 19, and an operation portion 20 constituted by a keyboard and a display. The operation portion 20 inputs an operation command or the like of this embodiment.

Figure 2:
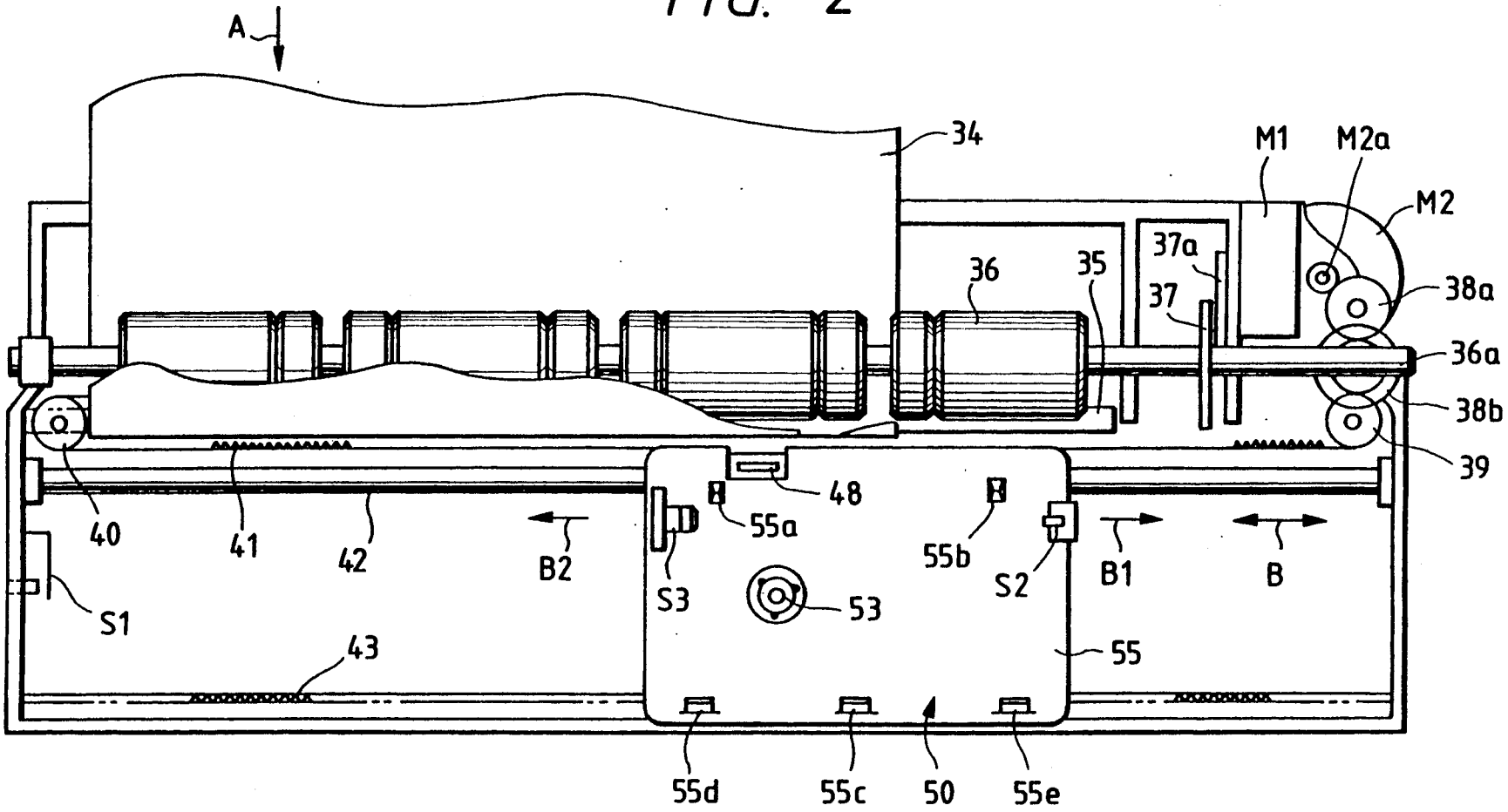
FIG. 2 is a schematic view showing an arrangement of a ribbon mechanism and a printer driving unit of the first embodiment.

FIG. 2 shows a part of the ribbon mechanism 17 and the printer driving unit 19 of the first embodiment.

Referring to FIG. 2, a recording sheet 34 is urged against a rubber portion of each sheet feed roller 36 by a pinch roller 36*b* while it is backed up by a platen 35. A gear 37 is mounted on a shaft 36*a* of the sheet feed roller 36 and coupled to a sheet feed motor M1 via a reduction gear 37*a*. Therefore, the sheet feed roller 36 rotate upon rotation of the sheet feed motor M1 to convey the recording sheet 34.

Therefore, when a thermal head 48 (to be described later) presses against the recording sheet 34 through an ink ribbon to perform recording, the platen 35 keeps the position of the recording sheet 34.

Reciprocation of a carriage 50 will be described below.

A parallel shaft 42 is provided before the platen 35, and a rack 43 is fixed at an opposite side of the carriage 50 to obtain a predetermined positional relationship with respect to the shaft 42. The carriage 50 is mounted and designed so as to be movable in a direction indicated by an arrow B such that a predetermined positional relationship defined by the upper surface of the shaft 42 and a guide surface on the upper surface of the rack 43 is maintained. That is, the carriage 50 can reciprocate in the direction perpendicular to a conveying path A of the recording sheet 34.

A portion of a belt 41 is fixed to the carriage 50 and extended by a pulley gear 39 and a pulley 40. The pulley gear 39 is coupled to a driving shaft M2*a* of a carriage motor M2 via reduction gears 38*a* and 38*b*. Therefore, when the carriage motor M2 rotates, this rotation is transmitted to rotate the pulley gear 39 via the reduction gears 38*a* and 38*b*. As a result, the belt 41 is driven to reciprocate the carriage 50 fixed to the belt 41 along the shaft 42 (in the direction indicated by the arrow B).

A head holder 55 for stacking two ink ribbon cassettes is rotatably supported by a head holder shaft (not shown) of the carriage 50. The thermal head 48 is mounted on the head holder 55. The head holder 55 also serves as a heat sink for radiating heat generated by the thermal head 48. A color sensor (color detecting means) S3 (the sensor 15 in FIG. 1) for discriminating colors of a multicolor ink ribbon in an ink ribbon cassette 60 is arranged on the head holder 55. The carriage 50 also includes a ribbon sensor S2 for detecting the presence/absence and type of the ink ribbon cassette 50 and detecting an ink ribbon end.

Pins 35*a* and 35*b* and hooks 35*c*, 35*d*, and 35*e* are formed on the upper surface of the head holder 55 so that the ink ribbon cassette 60 can be detachably loaded.

A structure of the ink ribbon cassette 60 for use in the apparatus of this embodiment to be loaded in the head holder 55 shown in FIG. 2 will be described below with reference to FIGS. 3 and 4.

Figure 3:
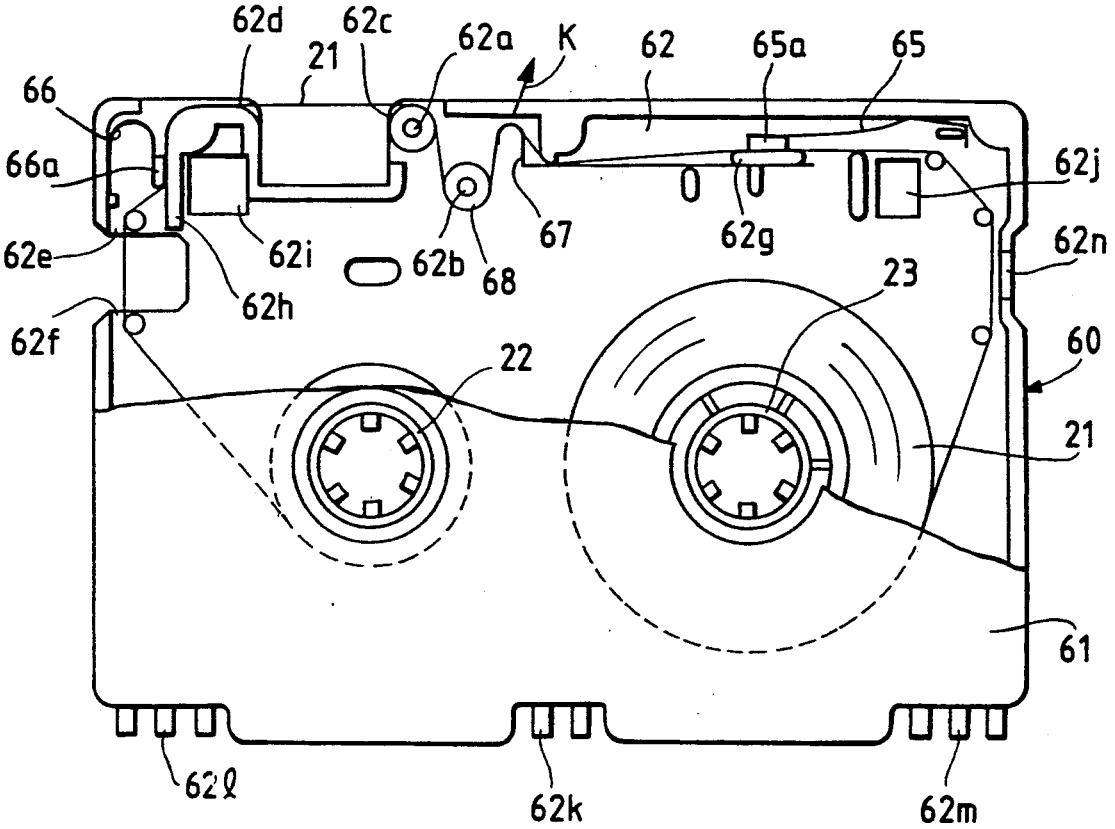
FIG. 3 is a plan view showing an ink ribbon cassette of the first embodiment.
Figure 4:
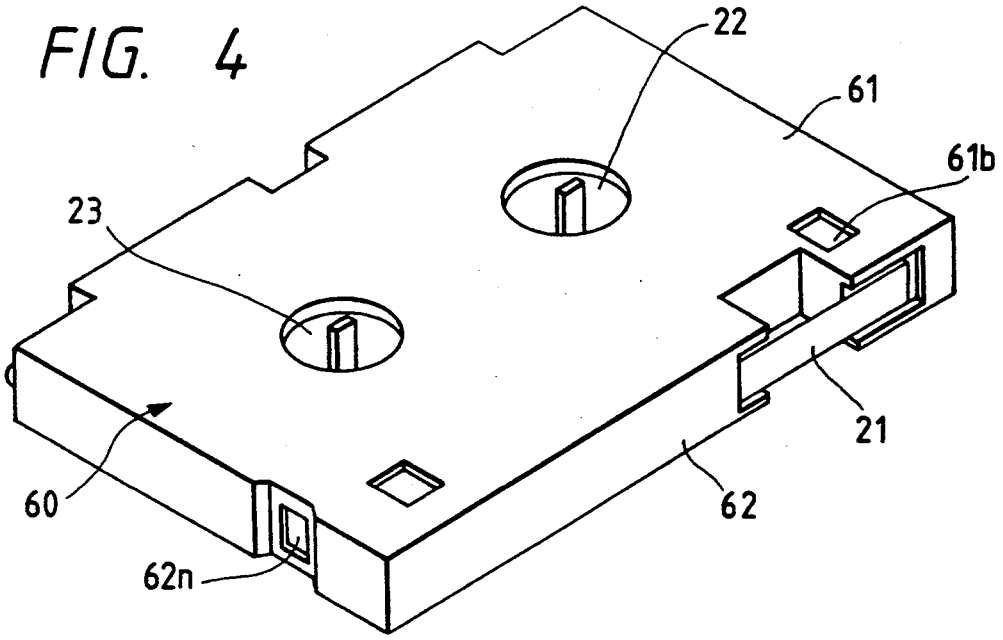
FIG. 4 is a perspective view showing an ink ribbon cassette of the first embodiment.

Referring to FIGS. 3 and 4, the ink ribbon cassette 60 is constituted by an upper case 61 and a lower case 62 and detachably loaded in the head holder 55 while an ink ribbon 21 is housed in the cassette 60.

The ink ribbon 21 is wound around a supply core 23. The ink ribbon 21 is temporarily exposed outside the cassette 60 from an opening portion 62*c* of the lower case 62 via rollers 68 rotatably mounted on projecting portions 62*a* and 62*b* of the lower case and guided inside the cassette 60 from an opening portion 62*d* of the lower case. Thereafter, the ink ribbon 21 is exposed outside the cassette 60 from a lower case opening portion 62*e*, guided inside the cassette 60 from a lower case opening portion 62*f*, and wound on a winding core 22.

The structure is arranged such that when the cassette 60 is loaded in a predetermined position of the head holder 55, the ink ribbon 21 exposed from the opening portions 62*c* and 62*d* is positioned between the head 48 at the main body side and the opposed recording sheet. Therefore, the ink ribbon 21 can be reliably and easily heated by the thermal head 48, which has a plurality of heating elements which generate heat in accordance with recording information. In addition, the ink ribbon 21 is biased against projecting portions 62*g* and 62*h* of the lower case 62 by pressure springs 65 and 66 formed in the lower case 62. Note that felt pieces 65*a* and 66*a* are attached to the pressure springs 65 and 66 to prevent the ink ribbon 21 from being damaged by the biasing force.

Figure 13:
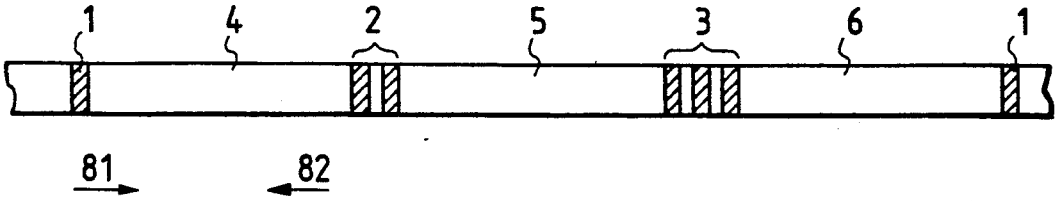
FIG. 13 is a view showing an ink ribbon using a bar code having the same information in forward and backward directions.

A tension spring 67 biases the ink ribbon 21 in a direction indicated by an arrow K in FIG. 13, thereby eliminating slack in of the ink ribbon 21 in association with the pressure springs 65 and 66.

A portion of the ink ribbon 21 is exposed through opening portion 62*n* of the lower case 62. When the cassette 60 is loaded in a predetermined position of the head holder 55, the ribbon sensor S2 at the main body side shown in FIG. 2 is located at the opening portion 62*n* of the cassette 60 to detect the ribbon end of the ink ribbon 21. The color sensor S3 at the main body side shown in FIG. 2 opposes the portion of the ink ribbon 21 exposed through the opening portions 62*e* and 62*f* of the lower case 62.

The operation of detachably loading the ink ribbon cassette 60 described above in the head holder 55 will be described below.

In order to load the ink ribbon cassette 60 in a lower stage, openings 61*a*, 61*b*, 62*i* and 62*j* formed in the upper and lower cases 61 and 62 of the ink ribbon cassette 60 are fitted on the pins 35*a* and 35*b* of the head holder 55, and the hook 35*c* is elastically engaged with a locking portion 62*k* of the lower case.

As a result, the ink ribbon cassette 60 is detachably loaded on the head holder 55.

In order to load the ink ribbon cassette 60 in an upper stage after the ink ribbon cassette 60 is loaded in the lower stage, the openings 61*a*, 61*b*, 62*i* and 62*j* are similarly fitted on the pins 35*a* and 35*b* of the head holder 55, and the hooks 35*d* and 35*e* are elastically engaged with the locking portion 62*k* of the lower case.

As a result, the ink ribbon cassette 60 of the upper stage is detachably loaded on the head holder 55.

The color ink ribbon 21 in the ink ribbon cassette 60 used in the first embodiment will be described in detail below with reference to FIG. 5.

Figure 5:
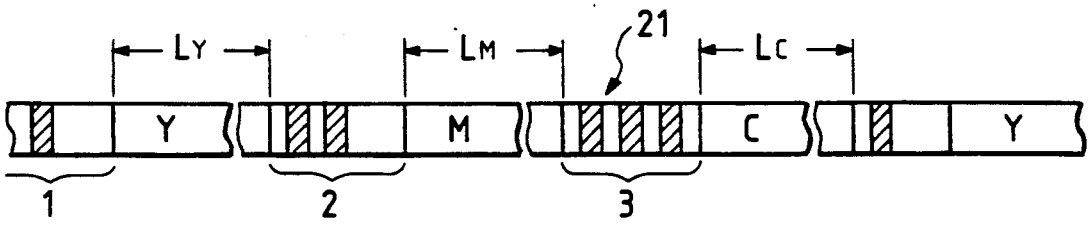
FIG. 5 is a view showing an arrangement of a color ink ribbon of the first embodiment.

A ribbon shown in FIG. 5 is an example of a color ink ribbon 21 used in this embodiment in which three different color inks, yellow (Y), magenta (M), and cyan (C) are alternately coated on the ribbon with a length "L" to form portions "$L_Y$", "$L_M$", and "$L_C$" with bar codes 1, 2, and 3 therebetween. That is, inks of the same colors are repeatedly coated in the order of yellow, magenta, and cyan in the entire widthwise direction of the color ink ribbon 21 for a length L in the longitudinal directions.

When the ribbon cassette 60 is loaded in a predetermined position of the head holder 55, the color sensor S3 at the main body side opposes the color ink ribbon 21 exposed from the opening portions 62*e* and 62*f* of the lower case 62.

When the color ink ribbon 21 is wound by the winding core 22, the color sensor S3 detects each of the bar codes 1, 2, and 3 on the color ink ribbon 21 to discriminate the ink color which follows the detected bar code.

Each color may be discriminated in accordance with the number of black lines of the bar code as shown in FIG. 5 or the width of the black line. In this embodiment, the form of the bar code is not limited as long as a color can be discriminated.

In addition, the number of colors is not limited to three, i.e. Y, M, and C, but may be any number.

Figure 6:
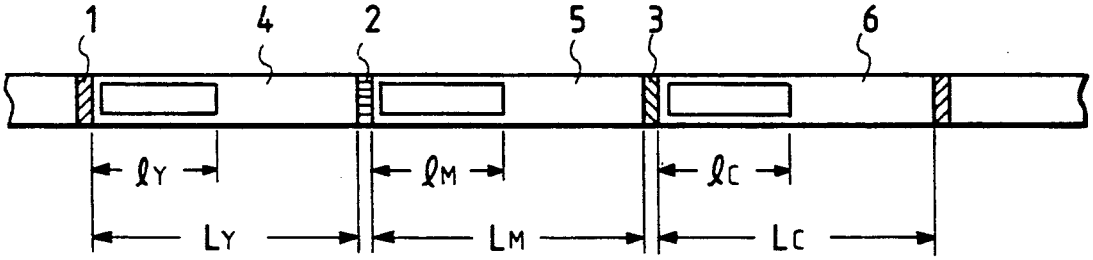
FIG. 6 is a view showing a state of the color ink ribbon of the first embodiment after it is used in recording.

FIG. 6 schematically shows a state in which the multicolor ink ribbon having the above arrangement for use in the color printer of this embodiment is divisionally used. Similar to FIG. 5, three different colors of ink, yellow (Y), magenta (M), and cyan (C), are sequentially coated on the ink ribbon shown in FIG. 6.

The ink ribbon shown in FIG. 6 has bar codes 1, 2, and 3 for discriminating yellow, magenta, and cyan ink coated positions, color ink portions 4, 5, and 6 of yellow, magenta, and cyan inks, continuous inks having coated lengths $L_Y$, $L_M$, and $L_C$ respectively, and lengths $l_Y$, $l_M$, and $l_C$ respectively, of portions used by recording the respective inks. That is, in FIG. 6, the yellow, magenta, and cyan inks are left nonused by lengths of $(L_Y-l_Y)$, $(L_M-l_M)$, and $(L_C-l_C)$ after the ink ribbon is used. Therefore, if recording can be performed again by using these ink nonused portions even after the ink ribbon is used in recording, the use efficiency of the ink ribbon is increased, and the ink ribbon 21 can be used without being wasted.

In this case, however, the lengths of the unused ink nonused portions left after the ink ribbon has been used for recording are different between the respective inks in accordance with the lengths $l_Y$, $l_M$, and $l_C$ used in recording. Therefore, recording may be performed by using ink used portions unless the lengths of ink nonused portions are detected.

In this embodiment, therefore, the following method is used in order to solve the above problem.

That is, a continuous ink coated portion of an ink of each color is divided into a predetermined number of areas, and only a particular designated area of the divided areas is used in recording, thereby solving the above problem.

That is, a user selects the desired number of divisions by using the keyboard of the operation portion 20 in consideration of recording contents. For example, by designating "3", a continuous ink coated length "L" of each color is divided into three areas each having a length of $\frac{1}{3}$ that of L as shown in FIG. 7 so that one ink ribbon divided area is used recording for each color.

Figure 7:
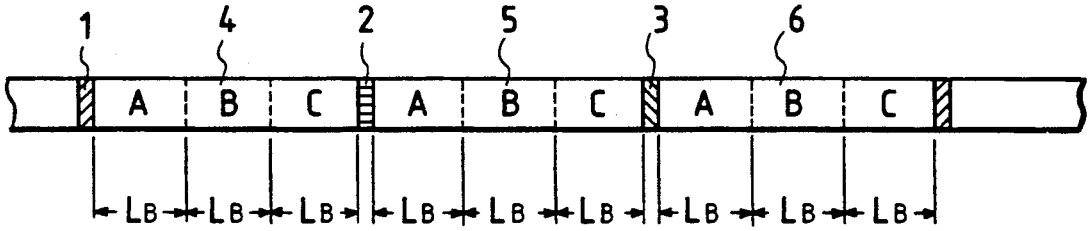
FIG. 7 is a view for explaining ink ribbon division according to the first embodiment.

For example, in a first recording operation, the ink ribbon is used to the end although only an area A of each color shown in FIG. 7 is used. Thereafter, only an area B of each color is used in a second recording operation, and only an area C of each color is used in a third recording operation.

In this manner, since an unused portion of the ink ribbon is always reused in recording when the ink ribbon is used, the above problem can be solved.

Note that a maximum continuous recording length "$L_B$" of each color is automatically changed in accordance with an input number of divisions.

In FIG. 7, for example, the number of divisions is "3" ($L_B=L/3$). If recording data exceeding "L/3" is to be recorded, recording of each color cannot be finished within a divided ink ribbon. In this embodiment, therefore, a bar code indicating the next same color portion is detected to continuously perform recording. As a result, recording data exceeding the divided area can be recorded without any problem.

Specific recording control of this embodiment will be described below with reference to a flow chart of FIG. 8.

In the apparatus of this embodiment, the number of divisions of the ink ribbon and the number of uses of the ink ribbon are selected via the keyboard of the operation portion 20 before recording begins. In addition, recording data for each color is stored in the RAM 12 via the host interface 13.

Note that the number of divisions may be determined in consideration of the width of a recording sheet so that continuous recording of one line can be performed on the recording sheet. That is, the number of divisions is determined such that the ink coated length $L_B$ is set to be slightly longer than the recording sheet width.

Figure 8:
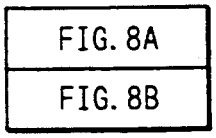
FIG. 8 is a flow chart for explaining recording control of the first embodiment.
Figure 8A:
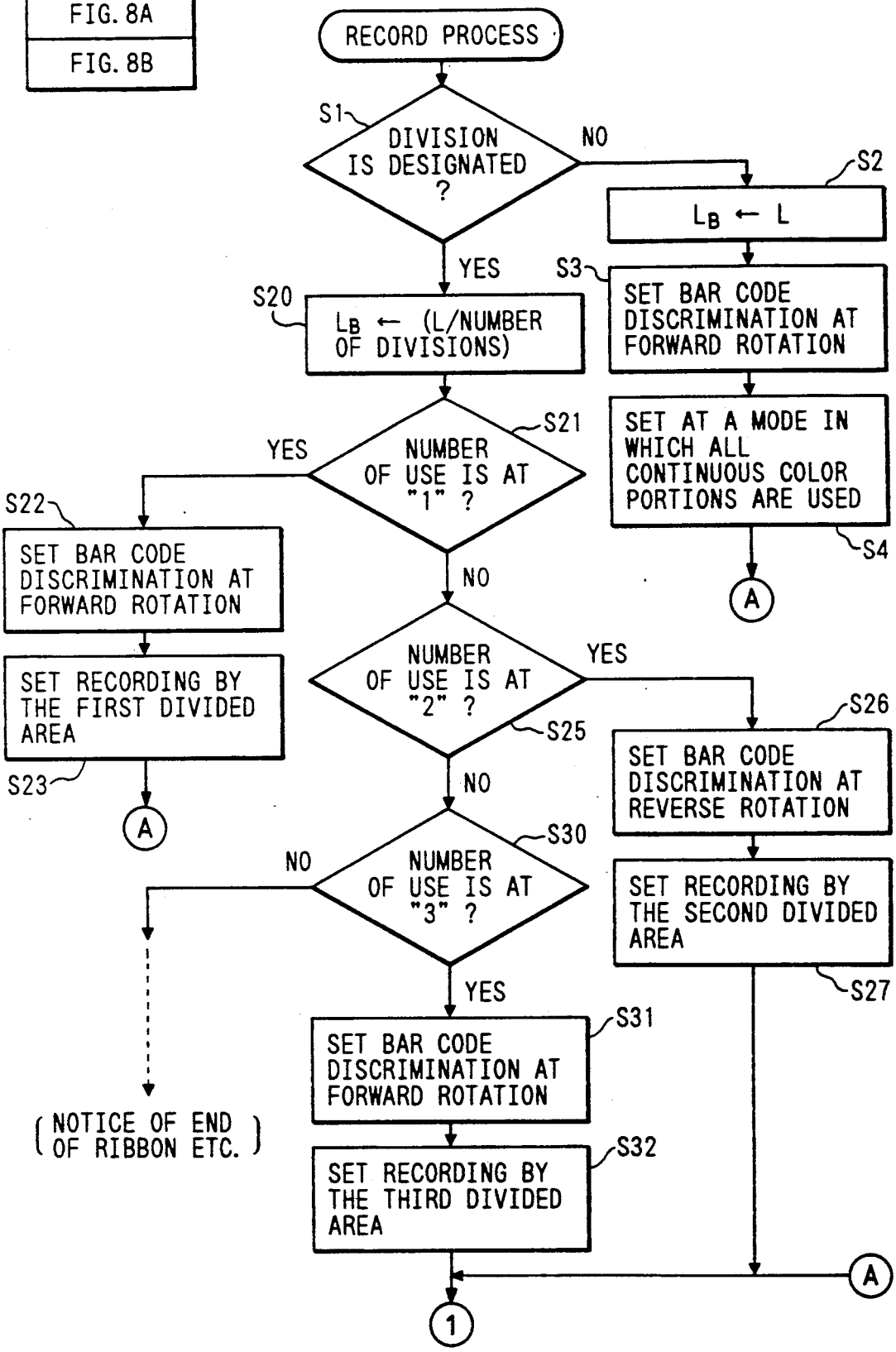
FIGS. 8A–8B are a detailed flow chart of FIG. 8.
Figure 8B:
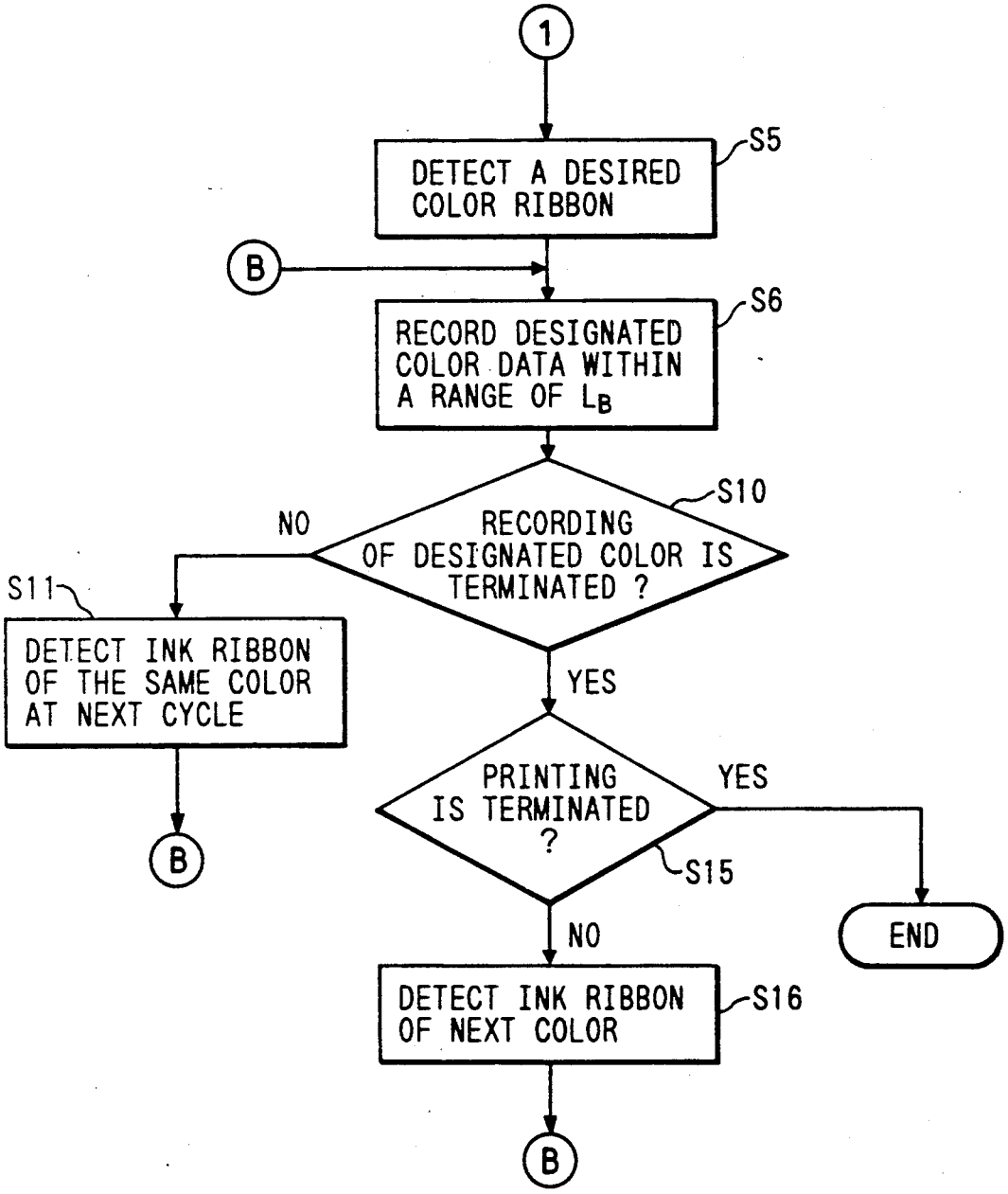

When a print start command is input, the operation advances to control shown in FIG. 8 to sequentially perform color recording in units of lines.

In step S1, the CPU 10 checks whether division is designated from the operation portion 20. If no division is designated in step S1, the flow advances to step S2, and the maximum continuous recording length "$L_B$" of each color is set to be the continuous ink coated length "L" of each color. In step S3, a bar code discrimination mode of the bar code reading unit 14 is set at a forward rotation discrimination mode in which an ink color specified by a bar code to be read by the sensor 15 is coated subsequent to the bar code. In step S4, a mode is set such that all continuous ink coated lengths "L" of each color are used to perform recording, and the flow advances to step S5.

In step S5, the CPU 10 activates the ribbon feed control unit 16 to drive the ribbon until the ink ribbon color to be recorded is detected by the sensor S3 and the bar code reading unit 14. When a desired color position is detected, the flow advances to step S6. In step S6, the CPU 10 causes the printer recording and controlling unit to scan a recording head (not shown), and the designated color is recorded from the ink ribbon when the desired position is set. The ribbon feed control unit 16 drives the ink ribbon by a recording length. In this manner, recording data of the designated color is recorded within the range of $L_B$. In step S10, the CPU 10 checks whether recording of the designated color is terminated. If N (NO) in step S10, recording of the desired color is not terminated. Therefore, in step S11, the CPU 10 activates the ribbon feed control unit 16 to drive the ink ribbon until the bar code reading unit 14 detects the next portion of the ink ribbon which is the same color (the same ink position of the next cycle). When a desired color position is detected, the flow returns to the processing of step S6 and subsequent steps, and the processing is repeatedly performed until recording of the designated color is terminated.

If recording of the designated line is terminated in step S10, the flow advances to step S15, and the CPU 10 checks whether recording of all the recording data in the RAM 12 is terminated. If Y (YES) in step S15, the recording processing is terminated.

If additional data must still be recorded, the flow advances to step S16, and the CPU 10 activates the ribbon feed control unit 16 to drive the ink ribbon 21 until the bar code reading unit 14 detects the ink ribbon color to be recorded next. If feeding of a recording sheet is required, the CPU 10 causes the recording and controlling unit 18 to perform necessary line feeding processing. When the desired color position is detected, the flow returns to the processing of step S6 and subsequent steps to record using of the next recording color.

If division is designated by the operation unit 20 in step S1, the flow advances to step S20, and the maximum continuous recording length "$L_B$" of each color is set to be a value "L/division number"60 obtained by dividing the continuous ink coated length "L" of each color by the designated number of divisions. In this embodiment, assume. that the number of divisions is three. (Of course, the number of divisions may be an arbitrary number, and a color ribbon can be repeatedly used by the designated number of divisions.)

Subsequent to step S20, the CPU 10 checks in step S21 whether the number of time the ink has been used, N, is 1, i.e., whether the ribbon is used for the first time. If the number of use N is being at "1", i.e., the ribbon is used for the first time, the flow advances to step S22. In step S22, the bar code discrimination mode of the bar code reading unit 14 is set for the forward rotation discrimination mode in which the ink color specified by the bar code to be read by the sensor 15 is coated subsequent to the bar code. In step S23, a mode is set such that recording is performed by using the first divided area within the continuous ink coated length "L" of each color. If the number of divisions is three, a mode in which the area A shown in FIG. 7 is used for each ink color is set. In this manner, initialization before the start of recording is terminated, and the flow advances to the processing of step S5 and subsequent steps.

In this case, recording of the length $L_B$ is started immediately after the desired color position of the ink ribbon is detected by the bar codes 1 to 3.

If N is not 1 in step S21, the flow advances to step S25, and the CPU 10 checks whether N=2, i.e., whether the ink ribbon is used for the second time. If the ink ribbon is used for the second time, i.e., N=2 in step S25, the flow advances to step S26. In step S26, the bar code discrimination of the bar code reading unit 14 is set at a reverse rotation discrimination mode, and a mode is set such that a bar code detection position to be read by the sensor 15 is the last one of an ink color specified by the bar code and an ink color coated subsequent to the bar code is an immediately preceding color. In this embodiment, if division is designated after an ink ribbon is recorded to the end the number of times that the ink ribbon has been used, N, incremented by one and the ink ribbon is driven in the opposite direction. Therefore, a reverse rotation discrimination mode is set. The ink ribbon is coated with inks in the order of yellow (Y), magenta (M), and cyan (C) such that Y→M→C→Y→M→C→Y→. . . Therefore, when a bar code of yellow (Y) is detected, it is determined that an ink of cyan (C) is coated on a subsequent area.

In step S27, a mode is set such that the second divided area within the continuous ink coated length "L" of each color is used to perform recording.

In this case, after a desired color position of an ink ribbon is detected by the bar code, the ink ribbon is driven by an amount equal to {(number of divisions)−2}$L_B$, and recording of the maximum length $L_B$ is started.

If the number of divisions is three, a mode in which the area B shown in FIG. 7 is used for each color is set. In this manner, initialization prior to recording is terminated, and the flow advances to the processing of step S5 and subsequent steps.

If the number of use N is not 2 in step S25, the flow advances to step S30, and the CPU 10 checks whether the number of use N is 3. If N=3 in step S30, the flow advances to step S31, and the bar code discrimination mode of the bar code reading unit 14 is set at the forward rotation discrimination mode in which an ink color specified by a bar code to be read by the sensor 15 is coated subsequent to the bar code. In step S32, a mode is set such that the third divided area within the continuous ink coated length "L" of each color is used to perform recording. If the number of divisions is three, a mode in which the area C shown in FIG. 7 is used for an ink of each color is set. In this manner, initialization prior to recording is terminated, and the flow advances to the processing of step S5 and subsequent steps.

In this case, after a desired color position of an ink ribbon is detected by the bar code, the ink ribbon is driven by a distance of "2$L_B$", and recording of the maximum length $L_B$ is started.

In this manner, the ink ribbon is repeatedly used by the number of divisions. When all of the divided areas of an ink ribbon are recorded, the recording processing is temporarily stopped and a ribbon replacement request or the like is displayed without performing reverse rotation of the ink ribbon, and the operation waits until a new ribbon is set.

Although the number of divisions is 3 in the above description, the number of divisions can be arbitrarily set to other values.

Figure 9:
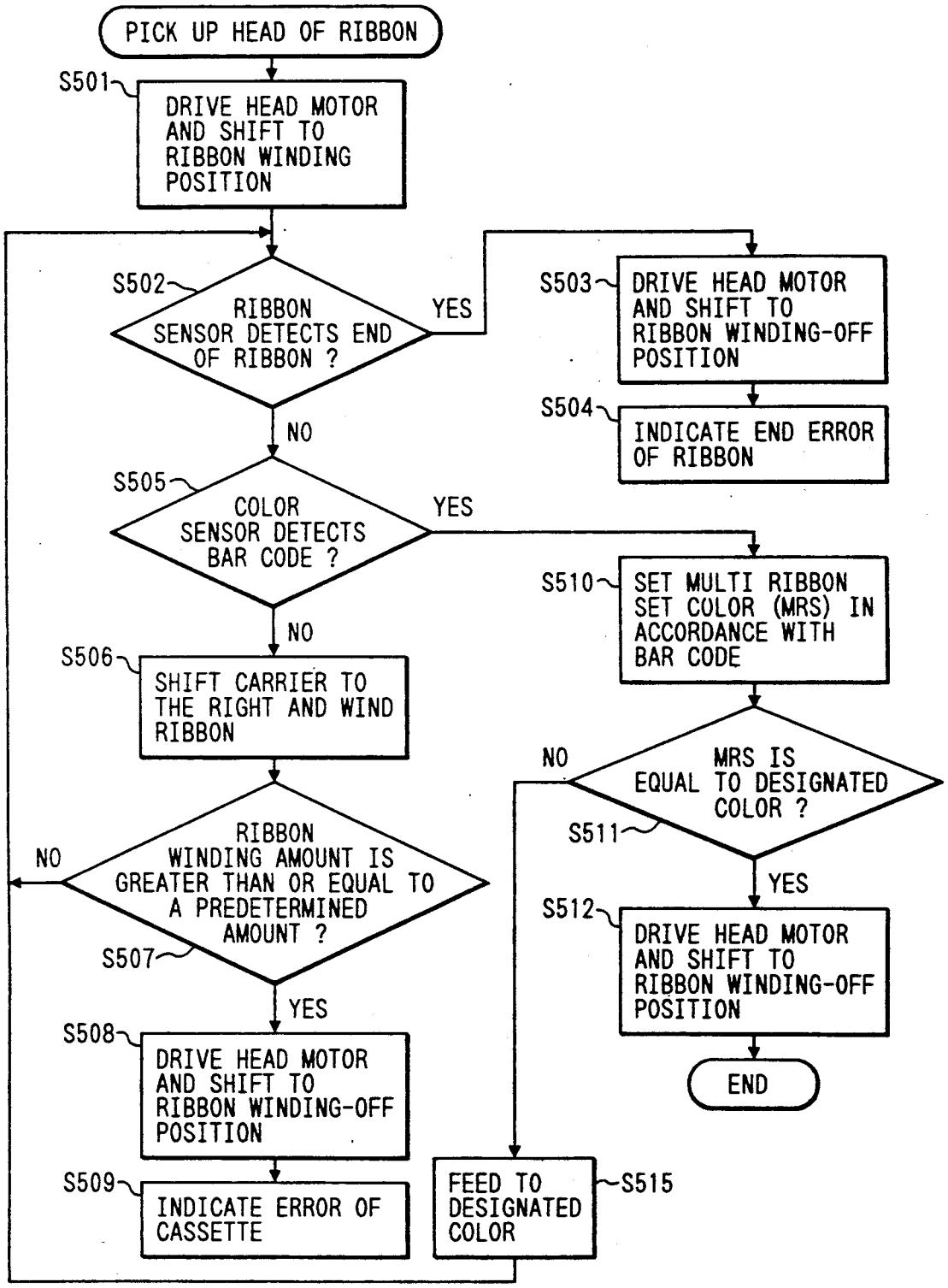
FIG. 9 is a flow chart for explaining ribbon head pick up processing of the first embodiment.

Ink ribbon head pick up processing of the ink ribbon 21 will be described in detail below with reference to a flow chart of FIG. 9.

The ribbon head pick up processing is performed by detecting the bar codes 1, 2, and 3 of the color ink ribbon 21 by the color sensor S3.

In step S501, the head motor M3 is driven to shift the ink ribbon cassette 60 to a ribbon winding-on position. In step S502, the CPU 10 checks whether the ribbon sensor S2 detects the ribbon end. If the ribbon end is detected in step S502, the flow advances to step S503, and the CPU 10 drives the head motor M3 to switch off ribbon winding. The flow advances to step S504, and a ribbon end error is displayed to terminate the processing.

If no ribbon end is detected in step S502, the flow advances to step S505, and the CPU 10 checks whether the color sensor S3 detects the bar code. If the bar code is not detected in step S505, the flow advances to step S506, and the CPU 10 drives the carriage motor M2 to move the carriage 50 in the recording direction (to the right), thereby winding the color ink ribbon 21. The flow advances to step S507, and the CPU 10 checks whether a ribbon winding amount is greater than or equal to the predetermined winding length "L". If the ribbon winding amount is smaller than the predetermined winding length, the flow returns to step S502, and ribbon winding and color sensor detection are repeatedly performed.

If the ribbon winding amount is greater than or equal to the predetermined winding length in step S507, the CPU 10 determines that the ink ribbon is not the multicolor ink ribbon but the monochromatic ink ribbon 21. Therefore, the flow advances to step S508, and the CPU 10 drives the head motor M3 to shift the cassette to the ribbon winding-off position. In step S509, a cassette set error is displayed.

If the color sensor S3 detects the bar code in step S505, the flow advances to step S510 to set a detection color of the color ink ribbon to be a color according to the bar code.

In step S511, the CPU 10 checks whether the detection color of the color ink ribbon is the designated color to be picked up. If the detection color is not the designated color to be picked up, the flow advances to step S515, and ribbon feeding is performed continuously until the bar code of the designated color is detected, and the flow returns to step S502. Note that if the detection color of the color ink ribbon is not determined after a power switch is turned on, a color cannot be determined when the head pick up processing is performed. In this case, therefore, processing of winding a ribbon to its initial state must be performed.

If the detection color of the color ink ribbon is the designated color to be picked up, the flow advances to step S512 to drive the head motor M3 to shift the cassette to the ribbon winding-off position, thereby terminating the ribbon head pick up processing for the designated color.

By performing the above processing, the head of a color ink ribbon can be picked up with high efficiency without being picked up unnecessarily. In addition, errors caused when a different ink ribbon is inserted can be detected.

When division is designated, ink ribbon areas recorded and transferred beforehand are skipped to start actual recording.

The ink ribbon divided areas need not be used in the order of A, B, and C as shown in FIG. 7 but may be used in an arbitrary order of, e.g., A, C, and B.

According to the first embodiment as described above, since a user can designate a desired number of divisions, the amount of ink not used can be minimized, increasing the recording use efficiency of the ink ribbon.

2nd Embodiment

In the above embodiment, a printer which can drive an ink ribbon in the opposite direction as well to perform bidirectional recording when the ink ribbon is used up in one direction has been described. The present invention, however, is not limited to the above embodiment but can be applied to a unidirectional recording printer.

Figure 10A:
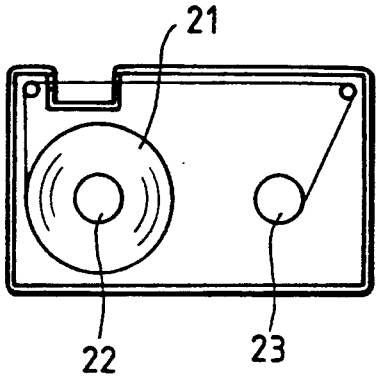
FIGS. 10A and 10B are schematic views showing the interior of the ink ribbon cassette of the first embodiment.
Figure 10B:
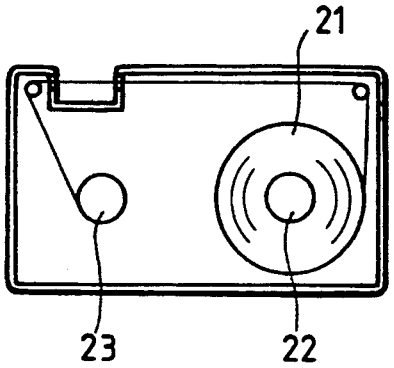

In this case, the interior of an ink ribbon cassette is as schematically shown in FIG. 10A after it is used. As shown in FIG. 10A, a used ink ribbon 21 is wound around a winding core 22 and therefore cannot be used in this state. Therefore, the cassette case is designed to be disassembled so that a user can extract the ink ribbon 21, the winding core 22, and the supply core 23. The extracted parts are reversed and replaced in the cassette case as shown in FIG. 10B. Since this state is identical to an initial state, the ink ribbon can be reused.

Note that when an ink ribbon is reversed and reset, the combination of each color bar code and the color of an ink coated portion is different from an original combination. Therefore, a bar code discrimination mode is set at a reverse rotation mode as shown in step S26 to read the ink ribbon in a different manner such that yellow is discriminated after a bar code for magenta, magenta is discriminated after a bar code for cyan, and cyan is discriminated after a bar code for yellow.

Alternatively, an ink ribbon rewind mechanism may be used to rewind an ink ribbon to its initial state. As a result, the initial state shown in FIG. 10B can be achieved without having to open the cassette case. In this case, however, the bar code discrimination mode is always maintained in the forward rotation mode.

Figure 11A:
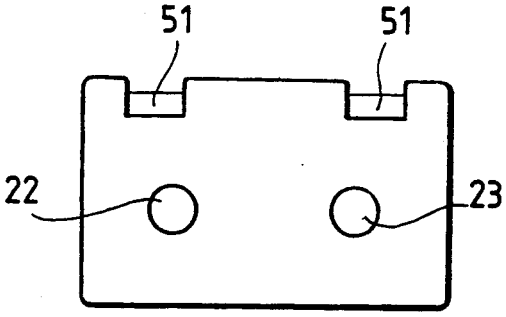
FIGS. 11A and 11B are views showing ink ribbon cassettes of the second embodiment according to the present invention.
Figure 11B:
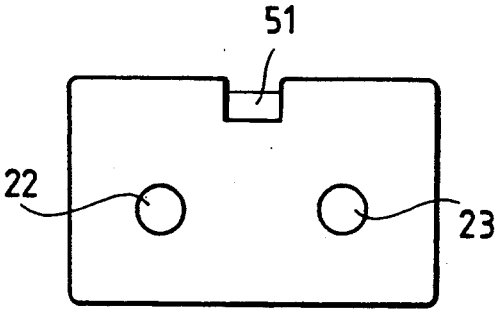

In addition, the shape of the ink ribbon cassette may be as shown in FIGS. 11A and 11B. In FIGS. 11A and 11B, recording head insertion opening portions 51, the winding core 22, the supply core 23, an engagement portion between the ink ribbon cassette and a loading portion, and the like are symmetric.

With this arrangement, the ink ribbon can be immediately reused simply by reversing and then reloading the ink ribbon cassette after it is used without disassembling the ink ribbon cassette or rewinding the ink ribbon.

In this case, the upper and lower surfaces of the ink ribbon are alternately used such that the upper surface in a forward rotation state is used for the first time and the lower surface in a reverse rotation state is used for the second time.

Therefore, the bar code discrimination mode can be automatically switched between the upper surface detection mode at forward rotation and the lower surface detection mode at reverse rotation in accordance with whether an input value of the number of use is an odd or even number. In this manner, switching between forward rotation/reverse rotation of the bar code discrimination mode cannot be performed accidentally.

Control to be performed when the number of divisions is designated to be "4" will be briefly described below with reference to FIG. 12.

Figure 12:
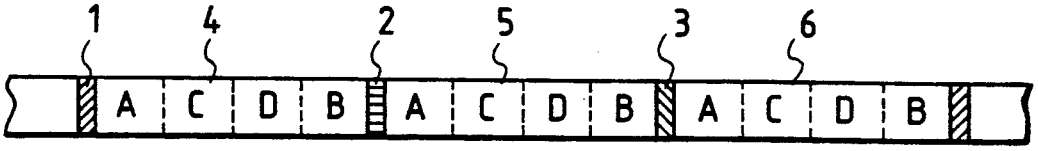
FIG. 12 is a view for explaining ink ribbon division control according to the third embodiment.

By inputting "1" to indicate the first use of an ink ribbon cassette, only an area A shown in FIG. 12 is used for each color in the first recording.

In the second recording, the ink ribbon cassette is reversed to set its lower surface, and "2" is input to perform recording by using only an area B shown in FIG. 12. At this time, the input number is an even number, and the bar code discrimination mode is automatically switched to the reverse rotation mode.

In the third recording, the ink ribbon cassette is reversed again to set its upper surface, and "3" is input to perform recording by using only an area C shown in FIG. 12. At this time, an input number is an odd number, and the bar code discrimination mode is automatically switched to the forward rotation mode.

In the fourth and last recording, the ink ribbon cassette is inserted again to set its lower surface, and "4" is input to perform recording by using only an area D shown in FIG. 12. At this time, the input number is an even number, and the bar code discrimination mode is automatically switched to the reverse rotation mode.

Note that bar code discrimination mode switching between forward rotation/reverse rotation is not an essential means of the present invention but a matter of the bar code itself.

That is, in the above description, assume that an ink ribbon in which a bar code for color discrimination has entirely the same information in a forward rotation direction indicated by an arrow 81 in FIG. 13 and a reverse rotation direction indicated by an arrow 82 therein is used.

Figure 14:
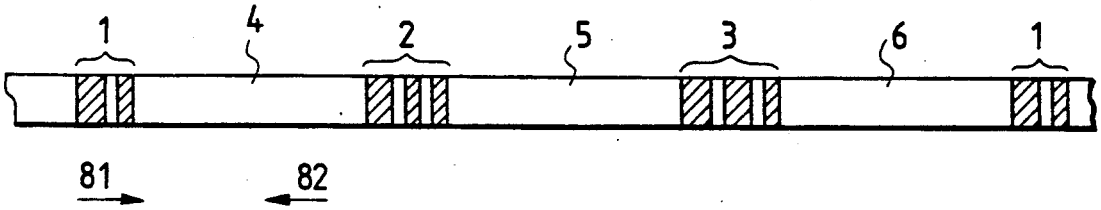
FIG. 14 is a view showing an ink ribbon using a bar code having different information in forward and backward directions.

If, however, a bar code has different information in the forward and reverse rotation directions as shown in FIG. 14, a color can be directly determined without having to discriminate between the forward and reverse rotations. That is, in FIG. 14, yellow ink is discriminated when bars of the bar code are "thick and thin" or "thin, thin, and thick", magenta ink is discriminated when they are "thick, thin, and thin" or "thin, thick, and thick", and cyan ink is discriminated when they are "thick, thick and thin" or "thin and thick".

According to the second embodiment as described above, since a user can designate a desired number of divisions, the amount of unused ink can be minimized to increase the recording use efficiency of an ink ribbon.

In order to perform ink ribbon driving and recording control in the above description with higher reliability and operability, the apparatus can be arranged so that the loading state of an ink ribbon cassette can be discriminated.

Figure 15:
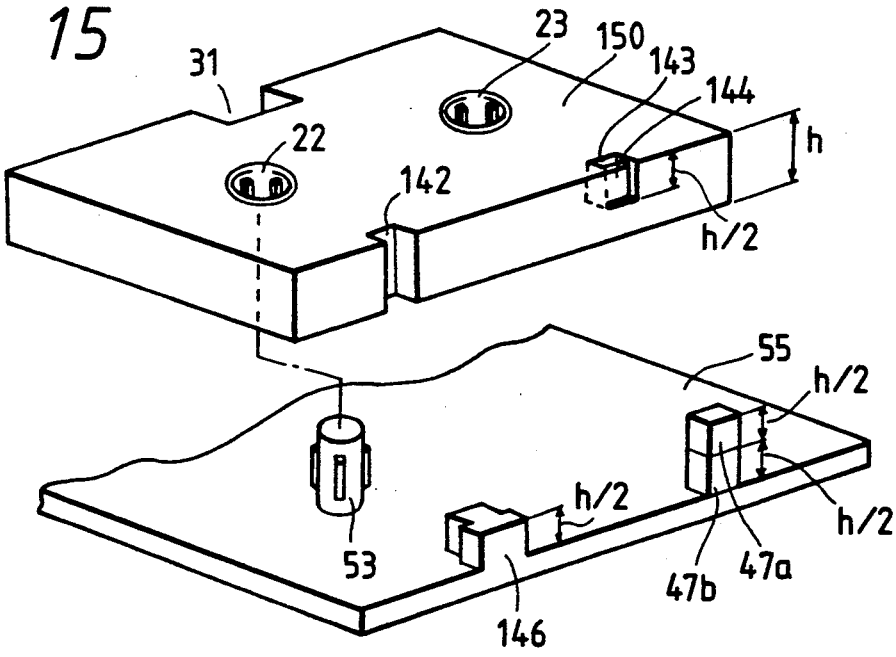
FIG. 15 is a perspective view showing an arrangement of an ink ribbon cassette and a carrier upper portion of the third embodiment according to the present invention.

FIG. 15 is an upper perspective view showing a symmetrical (left-to-right reverse type) cassette case 150 and a head holder 55 for loading the cassette case according to this arrangement.

Referring to FIG. 15, two recesses 142 and 143 are formed at symmetrical positions about the center of the cassette case 150. As shown in FIG. 15, the recess 142 is formed throughout a thickness h of the case, and the recess 143 is formed by only a half thickness (h/2) of the case. A thin-plate-like lug 144 which can be snapped is formed to cover an opening portion of the recess 143. An operator snaps the lug 144 as needed to expose the opening portion of the recess 143.

A head holder 55 of a printer driving unit 19 is arranged to load the cassette case 150 and has a recording head 48 at a position of an opening portion 31 of the case 150. A projection 146 having a height substantially half the cassette case thickness h is formed on the head holder 55 at a position at which its distal end portion is fitted in the recess 142 when the cassette case 15 is loaded as shown in FIG. 15. Two sensors 47*a* and 47*b* each having a height substantially half the cassette case thickness h for detecting the presence/absence of an object before the sensor by using a mechanical contact or a photosensor are stacked at a position opposing the recess 143 when the cassette case 150 is loaded.

When the cassette case 150 is fitted as shown in FIG. 15, the distal end of the projection 146 is fitted in the recess 142, and the lug 144 at the opening portion of the recess 143 is located at a position opposing the upper sensor 47*a*. In addition, a winding reel 53 meshes with a winding core 22.

Recording and ink ribbon control performed when the cassette case 150 and the carrier 50 having the above arrangement are used will be described below.

In this case, whether an ink ribbon is divisionally used and whether the upper surface of the cassette case 150 is used or its lower surface is used in a reverse rotation mode can be automatically discriminated in accordance with detection output values from the two sensors 47*a* and 47*b*, and a bar code discrimination mode switching can be automatically controlled. Detection states and corresponding control modes of the sensors 47*a* and 47*b* in this arrangement are shown in Tables 1A and 1B.

TABLE 1A

| | | |
|---|---|---|
| Sensor 47a | ON | Printing Control Is Normal Mode |

TABLE 1A-continued

| | | |
|---|---|---|
| | OFF | Printing Control Is Divisional Printing Designation Enable Mode |
| Sensor 47b | ON | Bar Code Discrimination Mode Is Upper Surface Forward Rotation Mode |
| | OFF | Bar Code Discrimination Mode Is Lower Surface Reverse Rotation Mode |

TABLE 1B

| Control Mode | Sensor 47a | Sensor 47b |
|---|---|---|
| Mode 1 | ON | ON |
| Mode 2 | OFF | ON |
| Mode 3 | OFF | OFF |

In the above arrangement, if an ink ribbon is not used in a reverse rotation mode, i.e., if one continuous ink coated area of each color of the ink ribbon is not divisionally used but entirely used to perform color transfer in one recording operation as in a conventional arrangement, the cassette case is used as shown in FIG. 15 without snapping the lug 144. Since both the sensors 47*a* and 47*b* detect an object at the opposing position and output detection signals of "ON", it is determined that printing control is set at the normal recording mode and the bar code discrimination mode is set at the forward rotation mode as shown in Table 1A. In this case, the control mode of mode 1 shown in Table 1B is selected to set normal recording control without performing divisional recording.

In this case, even if a user tries to reversely load the ink ribbon after one reel of the ink ribbon is used up, the cassette case 150 cannot be loaded on the head holder 55 because the lug 144 abuts against the distal end portion of the projection 146. Therefore, when the entire area of the ink ribbon is normally used, the cassette case 150 cannot be erroneously reversely loaded to reuse the used ink ribbon.

In order to divisionally use one continuous ink coated portion, the cassette case 150 is loaded after the lug 144 is snapped to expose the opening portion of the recess 143.

When the cassette case 150 is loaded on the carrier 45 such that the projection 146 is fitted in the recess 142 as shown in FIG. 15, the sensor 47*a* outputs a signal of "OFF" and the sensor 47*b* outputs a signal of "ON". Therefore, it is determined that recording control is set at the divisional recording designation enable mode and the bar code discrimination mode is set at the forward rotation mode. In this case, the control mode is set at the mode 2 shown in Table 1B to enable divisional recording input designation. Also in this state, the bar code discrimination mode can be automatically determined.

In order to use the ink ribbon cassette in the reverse rotation mode after one reel of an ink ribbon has been used up, the cassette case 150 can be loaded in the carrier 50 by fitting the distal end portion of the projection 146 of the carrier 50 into the recess 143 since the lug 144 is already snapped.

At this time, since the recess 142 is located at the opposing portion of the sensors 47*a* and 47*b*, both the sensors output signals of "OFF". Therefore, divisional recording input designation can be performed, the bar code discrimination mode is set at the reverse rotation mode using the lower surface, and the control mode 3 shown in Table 1B is set.

When the ink ribbon is wound, the control mode 2 is set again by reversing the ink ribbon. Thereafter, the ink ribbon can be similarly used.

The shape of the cassette case 150 is not limited to that of the above embodiment but may be any shape as long as the two sensors 47*a* and 47*b* and the projection 146 can be effectively used.

Figure 16A:
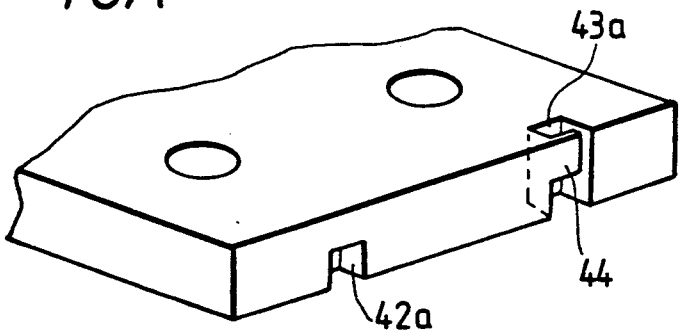
FIG. 16A is a perspective view showing a structure of a multicolor ink ribbon cassette of the fourth embodiment according to the present invention.
Figure 16B:
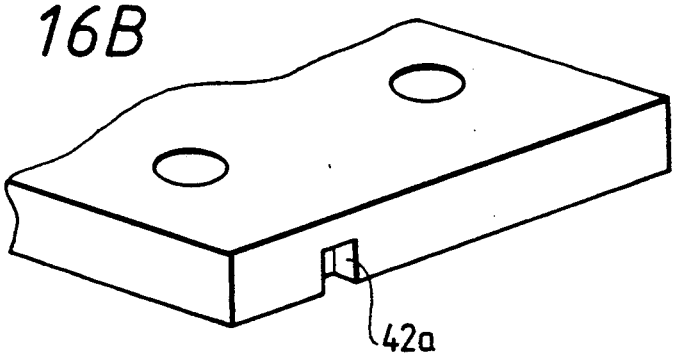
FIG. 16B is a perspective view showing a structure of a monochromatic ink ribbon cassette of the fourth embodiment according to the present invention.

FIGS. 16A and 16B show a cassette case 150 arranged to perform multicolor/monochromatic discrimination in addition to division discrimination and upper/-lower surface discrimination.

FIG. 16A shows a cassette case for multicolor recording, and FIG. 16B shows a cassette case for monochromatic recording.

In FIGS. 16A and 16B, a recess 142*a* is formed from the lower surface by a length which is a substantially half of a case thickness h so that the distal end portion of a projection 146 on a head holder 55 is fitted therein.

In the multicolor cassette case shown in FIG. 16A, a recess 143*a* is formed at an opposing position of sensors 47*a* and 47*b*. A thin-plate-like lug 144 which can be snapped is formed to cover an opening portion of the recess 143*a* from the surface side by a length which is a substantially half of the case thickness h, and a substantially half of the opening at the lower surface side is open.

With the above arrangement, outputs from the sensors 47*a* and 47*b* and discrimination states of required control can be specified as shown in Table 2.

TABLE 2

| | Sensor 47a | Sensor 47b | Discrimination State |
|---|---|---|---|
| 1 | ON | OFF | Multicolor Nondivisional Use |
| 2 | OFF | OFF | Multicolor Divisional Use Using Upper Surface |
| 3 | OFF | ON | Multicolor Divisional Use Using Lower Surface |
| 4 | ON | ON | Monochromatic |

Therefore loading states of both a multicolor ink ribbon and also a monochromatic ink ribbon can be discriminated, and recording control can be performed with high operability and reliability.

Figure 17:
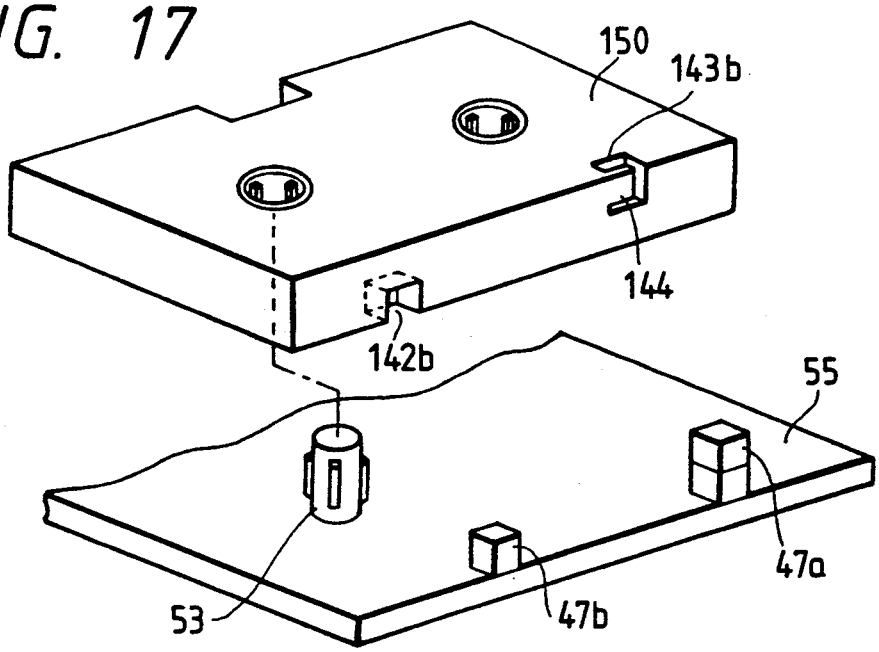
FIG. 17 is a perspective view showing an arrangement of an ink ribbon cassette and a carrier upper portion of the fifth embodiment according to the present invention.

FIG. 17 shows an arrangement of a cassette case 150 and a carrier base 55 which can be controlled to inhibit recording when a lug 144 for division discrimination is not snapped even if a ribbon cassette case can be reversely loaded, and Table 3 shows control states corresponding to sensor detection states.

TABLE 3

| | Sensor 47a | Sensor 47b | Control State |
|---|---|---|---|
| 1 | OFF | OFF | Divisional Use Enabled |
| 2 | ON | OFF | Divisional Use Disabled |
| 3 | OFF | ON | Printing Inhibited |

In the arrangement shown in FIG. 17, a recess 142*b* formed from the lower surface of a cassette case 150 by a substantially half thickness, and a recess 143*b* having an opening portion covered with a lug 144 by a substantially half thickness from the upper surface is formed.

In a head holder 55, a sensor 47*b* is located instead of the projection 146 shown in FIG. 15 at a position opposing the recess 142*b* of the cassette case 150, and a projection which projects from the head holder 55 by a height which is a substantially half of a cassette case thickness h is formed at the position of the sensor 47*b* shown in FIG. 15. A sensor 47*a* is fixed on this projection.

With this arrangement, discrimination as shown in Table 3 can be performed. Since control is performed to inhibit recording when the sensor 47*a* if "OFF" and the sensor 47*b* is "ON", an ink ribbon which is not divisionally used is not erroneously reversely loaded to use a used portion.

In each of the above ink ribbon cassette cases, discrimination of divisional use is performed by snapping the lug 144. An arrangement in which a predetermined discrimination mark is adhered by using a seal in place of the lug 144 and discrimination is performed by detecting the seal is included in the scope of the present invention.

In addition, when a seal is used, a bar code or the like indicating a desired number of divisions can be formed on the seal. Furthermore, a portion of the seal may be peeled each time an ink ribbon is used to discriminate the number of use of the ink ribbon. When control is performed in this manner, operability can be further improved.

According to the embodiments as described above, a user can designate a desired number of divisions to perform recording a plurality of times using divided areas of a continuous ink coated portion of each color. Therefore, the amount of unused ink can be minimized to increase the recording use efficiency of an ink ribbon.

As has been desired above, according to the present invention, when recording is to be performed by using a multicolor ink ribbon for a serial printer, a continuous ink coated portion of each color is divided into a plurality of areas and used in recording. Therefore, the amount of unused ink of the ink ribbon is reduced to increase the recording efficiency of the ink ribbon.

What is claimed is:

1. A multicolor ink ribbon recording control method using a multicolor ink ribbon having a plurality of differently colored and sequentially disposed inks, comprising:

providing a discrimination structure, formed in an ink ribbon cassette, for discriminating in accordance with a loading state or said cassette in a printer whether a continuous ink coated portion of each said color ink is divisionally used;

providing recognizing means in said printer, for recognizing a state of said discrimination structure of a loaded ink ribbon cassette; and providing recording control means in said printer, for performing recording control in accordance with a recognition result of said recognizing means, wherein whether divisional use is to be performed is determined in accordance with said discrimination structure formed in said ink ribbon cassette, and when divisional use is determined, a continuous coated portion of an ink of the same color is virtually divided into a plurality of areas and one of said plurality of areas is used to perform recording, a loading direction is reversed when one reel of an ink ribbon is recorded to an end, and the ink ribbon is reused under recording control according to a new discrimination result of said discrimination structure.

2. A method according to claim 1, wherein the number of divisions can be designated.

3. A method according to claim 1, wherein if recording data is longer than a divided area of one continuous ink portion, an area of the same color at the next cycle is used to perform recording.

4. A method according to claim 1, wherein said cassette recognizing means inhibits reverse loading of the cassette when an ink ribbon is not divisionally used.

5. A method according to claim 11 wherein said cassette recognizing means can discriminate a loading direction of the cassette.

6. A multicolor ink ribbon recording control method using a multicolor ink ribbon having a plurality of differently colored and sequentially disposed inks, comprising:

providing a discrimination structure, formed in an ink ribbon cassette, for discriminating in accordance with a loading state of said cassette in a printer whether a continuous ink coated portion of each said color ink is divisionally used;

providing recognizing means in said printer, for recognizing a state of said discrimination structure of a loaded ink ribbon cassette; and providing recording control means in said printer for performing recording control in accordance with a recognition result of said recognizing means, wherein whether divisional use is to be performed is determined in accordance with said discrimination structure formed in said ink ribbon cassette, and when divisional use is determined, a continuous coated ink portion of each color is virtually divided into a plurality of areas and only one of said plurality of divided areas is used to perform recording, and when the ink ribbon is recorded to an end, a loading direction of said ink ribbon cassette is changed to reversely load said ink ribbon cassette, and recording is performed by using a new divided area under recording control according to a new discrimination result of said discrimination structure.

7. A method according to claim 6, wherein the number of divisions can be designated.

8. A method according to claim 6, wherein if recording data is longer than a length of a divided area of one continuous ink portion, a divided area of the same color at the next cycle is used.

9. A method according to claim 6, wherein a bar code discrimination mode is automatically switched between a forward rotation mode and a reverse rotation mode in accordance with whether an input number of repetitive use is an odd number or an even number.

10. A multicolor ink ribbon recording control method using a multicolor ink ribbon having a plurality of differently colored and sequentially disposed inks, comprising:

providing a discrimination structure, formed in an ink ribbon cassette, for discriminating in accordance with a loading state of said cassette in a printer whether a continuous ink coated portion of each said color ink is divisionally used;

providing recognizing means in said printer, for recognizing a state of said discrimination structure of a loaded ink ribbon cassette; and providing recording control means in said printer, for performing recording control in accordance with a recognition result of said recognizing means, wherein whether divisional use is to be performed is determined in accordance with said discrimination structure formed in said ink ribbon cassette, and when divisional use is determined, a continuous coated ink portion of each color is virtually divided into a plurality of areas and only one of said plurality of divided areas is used to perform recording, and thereafter recording is sequentially performed by using the other area, and when the ink ribbon is recorded to an end, a loading direction of said ink ribbon cassette is changed to reversely load said ink ribbon cassette, and recording is performed under recording control according to a new discrimination result of said discrimination structure.

11. A method according to claim 10, wherein the number of divisions can be designated.

12. A method according to claim 10, wherein if recording data is longer than a length of a divided area of on continuous ink portion, a divided area of the same color at the next cycle is used to continuously perform recording.

13. A recording method for performing recording on a recording medium by using a multicolor ink ribbon having a plurality of differently colored and sequentially disposed inks, comprising:

providing a discrimination structure, formed in an ink ribbon cassette, for discriminating in accordance with a loading state of said cassette in a printer whether a continuous ink coated portion of each said color ink is divisionally used;

providing recognizing means in said printer, for recognizing a state of said discrimination structure of a loaded ink ribbon cassette; and providing recording control means in said printer, for performing recording control in accordance with a recognition result of said recognizing means, wherein whether divisional use is to be performed is determined in accordance with said discrimination structure formed in said ink ribbon cassette, and when divisional use is determined, a continuous coated ink portion of each color of said multicolor ink ribbon is virtually divided into a plurality of areas, and one of said divided areas is guided to a recording position to perform an operation of recording means in accordance with recording information, thereby performing recording on said recording medium, and when the ink ribbon is recorded to an end, a loading direction of said ink ribbon cassette is changed to reversely load said ink ribbon cassette, and recording is performed by using a new divided area under recording control according to a new discrimination result of said discrimination structure.

14. A recording apparatus for performing recording on a recording medium, comprising:

loading means for loading a multicolor ink ribbon having a plurality of differently colored and sequentially disposed inks in a loading direction;

recording means for performing an operation for recording use said multicolor ink ribbon loaded by said loading means;

discriminating means for discriminating in accordance with a loading state of an ink cassette in a printer whether a continuous ink coated portion of each said color ink is divisionally used, said discriminating means being formed in said ink ribbon cassette;

recognizing means for recognizing provided in said printer for recognizing a state of said discriminating means when said ink cassette is loaded;

recording control means provided in said printer for performing recording control in accordance with a recognition result of said recognizing means; and control means for virtually dividing one continuous ink portion of each color of said multicolor ink ribbon into a plurality of areas, performing recording by using one of said divided areas, reversing the loading direction of the ink ribbon when the ink ribbon is recorded to an end in accordance with a new discrimination result of said discriminating means and thereafter sequentially performing recording by using the other areas.

15. A method or apparatus according to claim 13 or 14, wherein said multicolor ink ribbon is an ink ribbon in which inks of a plurality of colors are alternately coated.

16. A method or apparatus according to claim 13 or 14, wherein the number of virtual divisions can be arbitrarily set by an operator.

17. A method or apparatus according to claim 13 or 14, wherein if recording data is longer than a length of a divided area of one continuous ink portion, a divided area of the same color at the next cycle is used to continuously perform recording.

* * * * *

UNITED STATES PATENT AND TRADEMARK OFFICE

CERTIFICATE OF CORRECTION

PATENT NO. : 5,104,247

DATED : April 14, 1992

INVENTOR(S) : NORIYOSHI OHSHIMA ET AL.

It is certified that error appears in the above-identified patent and that said Letters Patent is hereby corrected as shown below:

COLUMN 1

Line 9, "INVENTION:" should read --INVENTION--.

COLUMN 2

Line 33, "use" should read --uses--.
Line 48, "vided, if" should read --vided. If--.

COLUMN 3

Line 18, "pick" should read --pick- --.

COLUMN 4

Line 14, "rotate" should read --rotates--.

COLUMN 5

Line 24, "of" should be deleted.
Line 27, "opening" should read --an opening--.
Line 61, "cyan (C)" should read --cyan (C),--.
Line 68, "tions." should read --tion.--.

UNITED STATES PATENT AND TRADEMARK OFFICE

CERTIFICATE OF CORRECTION

PATENT NO. : 5,104,247

DATED : April 14, 1992

INVENTOR(S) : NORIYOSHI OHSHIMA ET AL.

It is certified that error appears in the above-identified patent and that said Letters Patent is hereby corrected as shown below:

COLUMN 6

Line 27, "inks, continuous inks having" should read --inks having continuous ink--.
Line 28, "$L_C$ respectively," should read --$L_C$, respectively,--.
Line 29, "$l_C$ respectively," should read --$l_C$, respectively,--.
Line 39, "nonused" should be deleted.
Line 58, "recording for" should read --for recording--.
Line 61, "end although" should read --end, although--.
Line 68, "used," should read --reused,--.

COLUMN 8

Line 12, "using" should read --use--.
Line 16, "60" should be deleted.
Line 24, "time the ink" should read --times the ink ribbon--.
Line 26, "being" should be deleted and "is" (second occurrence) should read --is being--.
Line 55, "end the" should read --end, the--.
Line 56, "incremented" should read --is incremented--.

COLUMN 9

Line 39, "pick up" should read --pick-up--.
Line 42, "pick up" should read --pick-up--.

UNITED STATES PATENT AND TRADEMARK OFFICE

CERTIFICATE OF CORRECTION

PATENT NO. : 5,104,247

DATED : April 14, 1992

INVENTOR(S) : NORIYOSHI OHSHIMA ET AL.

It is certified that error appears in the above-identified patent and that said Letters Patent is hereby corrected as shown below:

COLUMN 10

Line 22, "pick up" should read --pick-up--.
Line 29, "pick up" should read --pick-up--.

COLUMN 11

Line 52, "an input" should read --the input--.

COLUMN 12

Line 41, "cassette case 15" should read --cassette case 150--.

COLUMN 13

Line 21, "cassette case" should read --cassette case 150--.

COLUMN 14

Line 15, "recess 142a" should read --recess 42a--.
Line 16, "a" (second occurrence) should be deleted.
Line 20, "recess 143a" should read --recess 43a--.
Line 21, "thin-plate-like lug 144" should read --thin-plate-like lug 44--.
Line 23, "recess 143a" should read --recess 43a-- and "a" (second occurrence) should be deleted.
Line 24, "a" should be deleted.
Line 40, "Therefore" should read --Therefore,--.
Line 67, "a" (first occurrence) should be deleted.

UNITED STATES PATENT AND TRADEMARK OFFICE

CERTIFICATE OF CORRECTION

PATENT NO. : 5,104,247

DATED : April 14, 1992

INVENTOR(S) : NORIYOSHI OHSHIMA ET AL.

It is certified that error appears in the above-identified patent and that said Letters Patent is hereby corrected as shown below:

COLUMN 15

Line 5, "if" should read --is--.
Line 29, "desired" should read --described--.
Line 44, "or" should read --of--.

COLUMN 16

Line 6, "claim 11" should read --claim 1,--.

COLUMN 17

Line 4, "area," should read --areas,--.
Line 14, "on" should read --one--.

Signed and Sealed this

Seventeenth Day of August, 1993

Bruce Lehman

*Attest:*

BRUCE LEHMAN

*Attesting Officer*

*Commissioner of Patents and Trademarks*